US005336985A

United States Patent [19]

McKenzie

[11] Patent Number: 5,336,985

[45] Date of Patent: Aug. 9, 1994

[54] TAPPED INDUCTOR SLAVE REGULATING CIRCUIT

[75] Inventor: Philip J. McKenzie, Houston, Tex.

[73] Assignee: Compaq Computer Corp., Houston, Tex.

[21] Appl. No.: 973,267

[22] Filed: Nov. 9, 1992

[51] Int. Cl.[5] ..... G05F 1/56

[52] U.S. Cl. ..... 323/266; 323/267; 323/268; 323/282; 307/34

[58] Field of Search ..... 323/265–268, 323/271, 282, 284, 349, 350, 351; 307/31, 33–35; 363/15, 16

[56] References Cited

U.S. PATENT DOCUMENTS

| | | | |
|---|---|---|---|
| 4,660,136 | 4/1987 | Montorefano | 363/26 |
| 4,669,036 | 5/1987 | Cowett, Jr. | 363/21 |
| 4,870,555 | 9/1989 | White | 363/21 |
| 5,113,333 | 5/1992 | Ou | 363/25 |
| 5,119,013 | 6/1992 | Sabroff | 323/267 |
| 5,122,728 | 6/1992 | Ashley | 323/282 |

OTHER PUBLICATIONS

R. D. Middlebrook, A Continuous Model for the Tapped-Inductor Boost Converter, Proceedings of the IEEE Power Electronics Specialists Conference, Jun. 9–11, 1975, Culver City, Calif., pp. 55–71.

*Primary Examiner*—Steven L. Stephan
*Assistant Examiner*—Adolf Berhane
*Attorney, Agent, or Firm*—Pravel, Hewitt, Kimball & Krieger

[57] ABSTRACT

A tapped inductor slave regulating circuit provides a second slave output voltage derived from a tapped connection to the filter storage inductor of a first output voltage of a switching power supply converter. In the converter, an unregulated voltage is provided through a switching circuit to a storage inductor to develop a first output. The switching circuit is turned off and a synchronous rectifier is turned on to freewheel the current through the storage inductor and the load. The storage inductor is center-tapped and coupled to a switching circuit to provide a second slaved output. The location of the center tap is chosen to provide the proper voltage of the second output. In one embodiment, the switching circuit for the slaved output is turned on during the freewheel portion of each cycle to provide a proper voltage level for the second output. In another embodiment, a separate local feedback circuit is provided to further regulate the second output voltage level.

8 Claims, 3 Drawing Sheets

C2
5v
3.3v
GND
VIN
VDD
VREF
OPERATE
OSC
PWMTRIG
ERRPOS
ERRNEG
ERROUT
OPERATE
AGND
REFADJ
VDD
RDRIVE
RGATE
WDRIVE
WGATE
VREF

TAPPED INDUCTOR SLAVE REGULATING CIRCUIT

BACKGROUND OF THE INVENTION

1. Field of the Invention

The present invention relates to a circuit for providing a second output voltage derived from a tapped connection to the storage inductor of a first output voltage in a switching power supply converter.

2. Description of the Related Art

Computer systems are fast becoming smaller and more powerful. Although laptop computers still serve many needs, the smaller and more efficient notebook computers are becoming more popular since they are more convenient to use in the business environment. To achieve the reduction in size and increase in efficiency, computer designers of notebook computer systems must reduce power consumption in as many areas as possible. It has been recognized that one significant area to reduce the power consumption is to lower the voltage levels required to drive the logic and memory circuits of the computer system.

Most modern computer systems use logic circuits which require a 5 volt power supply for proper operation. Logic circuits are now available which operate with 3.3 volt power supplies, with the 3.3 voltage level quickly becoming a new standard in the industry. The lower 3.3 volt supply offers the advantages of reduced power consumption which significantly increases efficiency.

Many of the logic circuits operating on 3.3 volts, however, are much more expensive than their 5 volt counterparts, so that it is not necessarily cost effective to operate all of the logic systems with a single 3.3 volt power supply. For example, 3.3 volt dynamic random access memories (DRAMs) are available, but are very expensive. Additionally, while certain major components are available in 3.3 V versions, such as the microprocessor and the memory devices, many other components are not available in 3.3 V versions and conversion of these parts will not occur for some time. It is desirable therefore to have a hybrid system where a portion of the computer is operated from a 3.3 volt power supply, while the remaining portions of the computer are operated from a 5 volt source. A significant disadvantage with this type of hybrid computer system is that the power supply must now provide two separate output voltages, which effectively increases the size and complexity of the power supply. Since the 5 volt and 3.3 volt outputs are providing power for logic systems which generate signals with information content, these outputs must be relatively accurate.

In typical dual output voltage power supply converters of the prior art, one output is regulated while the other output is slaved to the regulated output by some second order effect such as transformer coupling. This method causes the slaved output to be less accurate than the regulated or primary output. The slaved output can be made more accurate by series regulation. Series regulation by means of a linear dissipative element, however, is inefficient. Series regulation with a magnetic amplifier, or an additional pass switched coupled with an inductor/capacitor (LC) filter is costly and bulky.

It is therefore desirable to provide a relatively efficient power supply converter having two separate and relatively accurate output voltages to drive the respective logic circuits, without significantly increasing the cost and size of the power supply.

SUMMARY OF THE PRESENT INVENTION

The present invention provides a second regulated output voltage of a switching converter without the size and cost of an additional magnetic component and without the losses associated with linear pass elements. Laptop and notebook computer systems typically include a buck-type DC—DC converter to provide the primary output voltage to power the logic circuitry. In a typical switching converter, a switching circuit couples an unregulated DC voltage through a storage element, such as a transformer or inductor, which is then typically filtered to provide a regulated output to a load. A feedback circuit coupled to the output provides a feedback signal to the switching circuit to control the voltage level at the output.

In the preferred embodiment according to the present invention, a switching circuit, which is preferably a pulse width modulation (PWM) circuit, alternatively drives two synchronous switches to develop a first output voltage. The PWM circuit activates a first switch which has a current path coupled between an unregulated DC voltage and a storage inductor, so that current flows from the unregulated DC voltage into the storage inductor. The other side of the storage inductor is the first output, which is usually connected to a filter and the load. The PWM circuit activates the second switch when the first switch is turned off, which provides a freewheel current path through the storage inductor and the load. A feedback circuit is coupled to the first output and to the PWM circuit to provide a closed loop control, which controls the switching action of the PWM circuit.

The storage inductor is preferably center tapped and coupled through a third switch to provide a second slaved output. The third switch provides a current path from the center tap to the second output voltage during the freewheel portion of the cycle while the second switch is turned on. In one embodiment, the second and third switches are turned on and off at the same time to develop the voltage for the second output. In this manner, the two output voltages are essentially regulated by the feedback circuit of the first output, so that both outputs essentially follow one another. In a second preferred embodiment, the second output voltage is coupled through a local feedback circuit to provide separate regulation of the second output voltage. In particular, the third switch is turned on only when the voltage level of the second output is low during the freewheel phase of each cycle.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
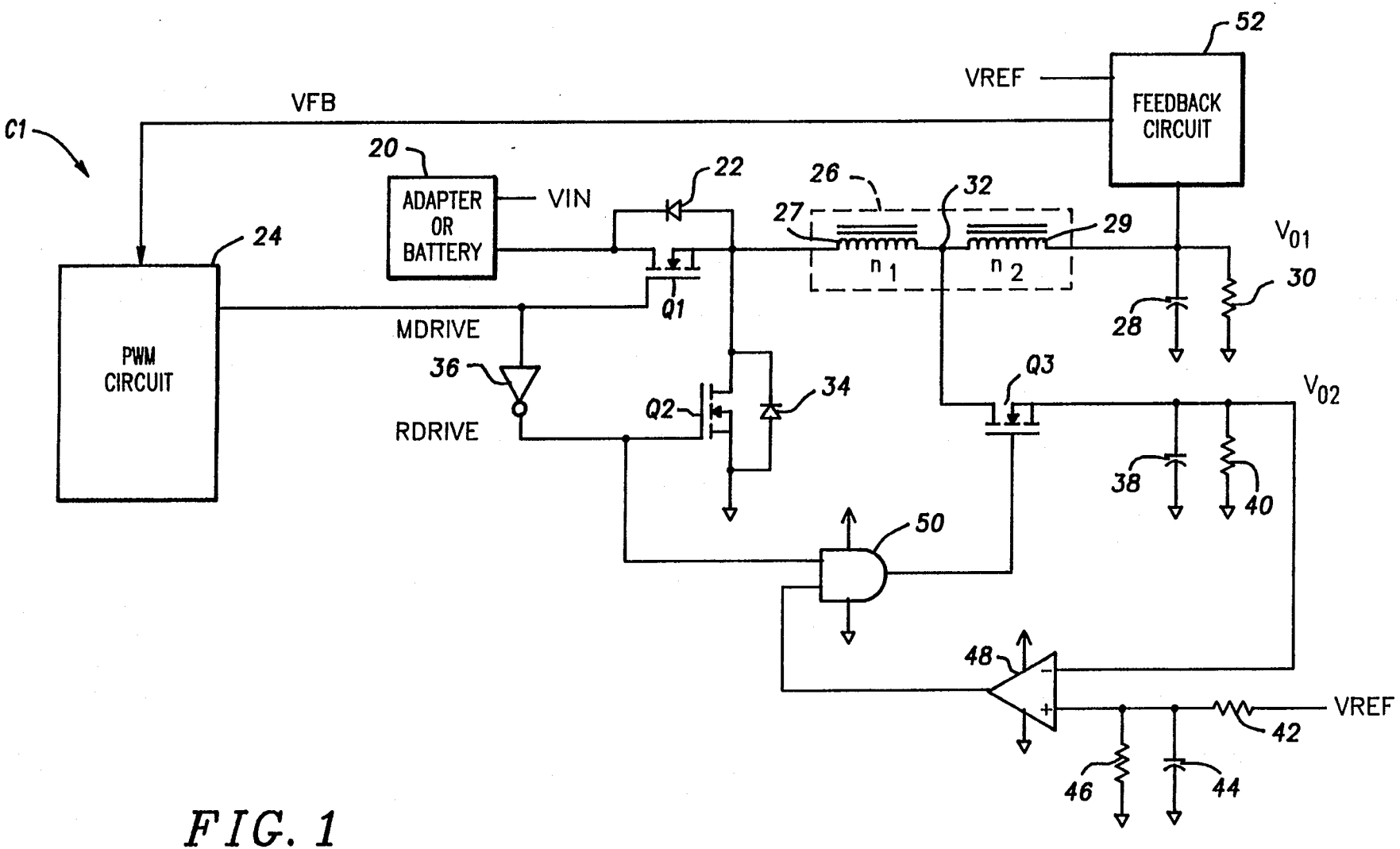
FIG. 1 is a schematic diagram of one embodiment of a power supply according to the present invention.

Referring now to FIG. 1, a schematic diagram is shown illustrating a buck-type switching converter C1 according to one embodiment of the present invention. An AC adapter means or rechargeable battery 20 provides an unregulated DC voltage referred to as VIN, which preferably varies between 6 and 20 volts. The VIN signal is connected to the drain of an n-channel metal oxide semiconductor field effect transistor (MOSFET), referred to as Q1, and also to the cathode of a diode 22. The anode of the diode 22 is connected to the source of the MOSFET Q1. The diode 22 is preferably inherent within the MOSFET Q1 as known to those skilled in the art and thus is not necessarily a separate circuit element. The gate of the MOSFET Q1 is connected to a signal MDRIVE which is provided by a pulse width modulated (PWM) circuit 24. The MDRIVE signal is preferably a square wave having sufficient power to drive the MOSFET Q1, where the square wave preferably has a duty cycle controlled by a signal VFB, as described more fully below.

The source of the MOSFET Q1 is connected to one side of a storage inductor 26, which has its other side providing an output signal referred to as VO1. Thus, the source and drain of the MOSFET Q1 provides a current path between the VIN signal and the storage inductor 26, when the MOSFET Q1 is turned on. The storage inductor 26 preferably comprises two coils 27 and 29 wound around the same core from the same wire separated by a center tap 32. The number of turns of the coil 27, referred to as n1, is not necessarily equal to the number of turns for the coil 29, referred to as n2, so that the center tap 32 is not necessarily at the center. A load and filter capacitor 28 is coupled in parallel between the VO1 signal and ground. A load resistor 30 is shown in parallel with the capacitor 28 and generally represents the load provided to the VO1 signal. The total inductance of the storage inductor 26 is determined so that an appropriate ripple current is provided to the load capacitor 28 as seen between the VO1 signal and ground. This is essentially a design consideration where the greater the inductance, the less the ripple current and thus the smaller the output voltage ripple appearing on the VO1 signal. However, too much ripple current tends to apply significant stress on the capacitor 28. Therefore, the storage inductor 26 is made as small as possible to reduce the size of the converter C1, but large enough to keep the ripple current at an acceptable level. A feedback circuit 52 receives the VO1 signal and compares it to a reference voltage signal, referred to as VREF. The feedback circuit 52 generates the VFB signal, where the VFB signal is representative of the error between the VREF and VO1 signals. The VFB signal is coupled to the PWM circuit 24 to complete the control loop.

A second n-channel MOSFET Q2 has its drain connected to the source of the MOSFET Q1 and its source connected to ground. A diode 34 has its anode connected to the source and its cathode connected to the drain of the MOSFET Q2, where the diode 32 is inherent within the MOSFET Q2 in a similar manner as the diode 22. The MDRIVE signal is shown connected to the input of an inverter 36, which has its output providing a signal RDRIVE, where the RDRIVE signal is connected to the gate of the MOSFET Q2. The inverter 36 is shown for simplification, since normally the PWM circuit 24 includes the drive circuitry to provide the RDRIVE signal. Thus, the MOSFET Q2 provides a current path between ground and the storage inductor 26 when the MOSFET Q2 is turned on, which occurs when the MOSFET Q1 is turned off.

In this manner, when the MDRIVE signal goes high, the MOSFET Q1 is turned on so that current flows from the adapter 20 through the storage inductor 26 to develop the VO1 signal. When the PWM circuit 24 drives the MDRIVE signal low, thereby turning off the MOSFET Q1, and the inverter 36 drives the RDRIVE signal high to turn on the synchronous MOSFET Q2, current freewheels from ground through MOSFET Q2 and the storage inductor 26 into the load resistor 30. Thus, the MOSFET Q1 is turned on while the synchronous MOSFET Q2 is turned off and vise versa, to properly maintain the VO1 signal at approximately 5 volts.

The center tap 32 is connected to the drain terminal of a third n-channel MOSFET Q3, which has its source terminal providing a second output voltage referred to as VO2. This provides a current path between the center tap 32 and the VO2 signal when the MOSFET Q3 is turned on. The turns ratio n1/n2 between the coils 27 and 29 of the inductor 26 are chosen so that VO2 signal would otherwise have a voltage greater than the desired 3.3 volts, although a separate feedback loop, described below, regulates the voltage of the VO2 signal to approximately 3.3 volts in the preferred embodiment. Although the VO1 and VO2 signals are preferably 5 and 3.3 volts, respectively, in the preferred embodiment, other voltages are contemplated so that the present invention is not limited to any particular voltage levels. A filter capacitor 38 and a load resistor 40 are coupled in parallel between the VO2 signal and ground. Again, the capacitor 38 filters the VO2 signal and the resistor 40 generally represents a load to the VO2 signal. The VO2 signal is preferably connected to the inverting input of a comparator 48, which has its non-inverting input connected to one side of a resistor 46 and to one side of a resistor 42. The other side of the resistor 46 is connected to ground, and the other side of the resistor 42 is connected to the VREF signal, which preferably has a voltage of approximately 5 volts. A filter capacitor 44 is coupled between the non-inverting input of the comparator 48 and ground.

The values of the resistors 42 and 46 are chosen to preferably divide the VREF signal so that the voltage appearing at the non-inverting input of the comparator is preferably the voltage level desired for the VO2 signal, which is preferably 3.3 volts. The output of the comparator 48 is connected to one input of a two-input AND gate driver 50, which has its other input connected to the RDRIVE signal. The output of the AND gate 50 is connected to the gate of the MOSFET Q3. The AND gate 50 has an output sufficient to drive the gate of the MOSFET Q3. Alternatively, other drive circuitry could be provided as would be known to those skilled in the art of circuit design.

The feedback circuit comprising the comparator 48 and the AND gate 50 provides a separate local regulation loop for the VO2 signal. Recall that the turns ratio n1/n2 between the coils 27 and 29 is chosen so that the VO2 signal would otherwise be greater than the desired 3.3 volts. If the VO2 signal is at the proper voltage level or above, the comparator 48 is turned off so that the output of the AND gate 50 is low shutting off the MOSFET Q3. This essentially isolates the center tap 32 and the VO1 signal from the VO2 signal. If the VO2 signal falls below the preferred voltage level, the output of the comparator 48 goes high. The output of the AND gate 50 goes high when the RDRIVE signal is pulled high and the output of the comparator 48 is high. Thus, the MOSFET Q3 is turned on synchronous with the MOSFET Q2 only when the output of the comparator 48 is driven high. In this manner, the feedback circuit comprising the comparator 48 and the AND gate 50 regulate the VO2 signal to the desired 3.3 volts.

It can now be appreciated that a second regulated voltage signal VO2 is derived as a slave voltage from a first voltage level VO1 through a center tap from the storage inductor 26, where the storage inductor 26 is used to develop the VO1 signal. The MOSFET Q3 is turned on to develop the voltage VO2 during the freewheel portion of the cycle of the PWM circuit 24, as further controlled by the feedback circuit comprising the comparator 48 and the AND gate 50. This circuit provides a regulated output voltage VO2 without the size and cost of additional magnetic components and without the losses associated with linear pass elements.

Figure 2:
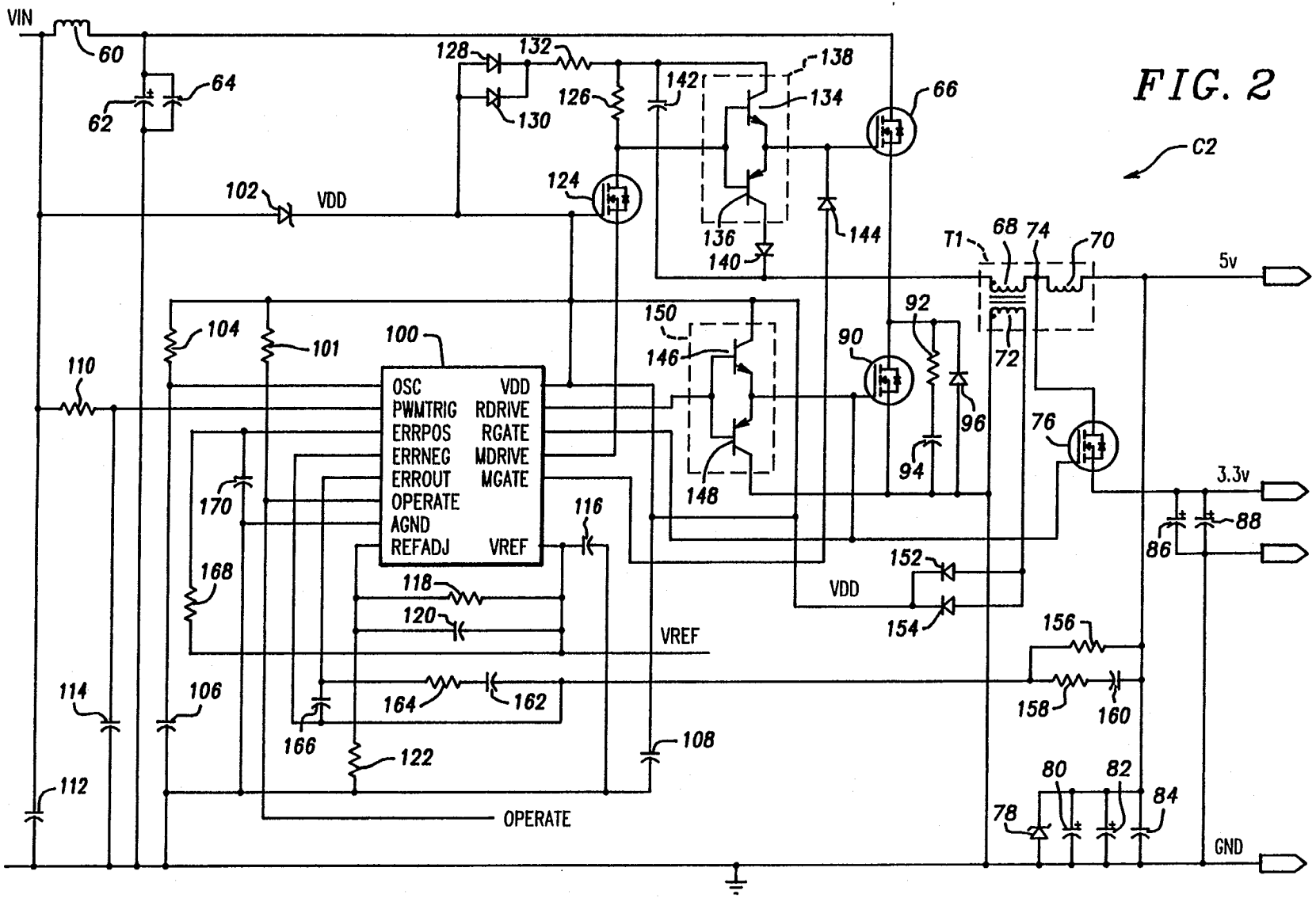
FIG. 2 is a schematic diagram of another embodiment according to the present invention.

Referring now to FIG. 2, a schematic diagram is shown illustrating a buck-type switching power supply converter, referred to as C2, according to another embodiment of the present invention. A signal VIN is provided to one side of a choke filter 60, where the VIN signal is analogous to the VIN signal of FIG. 1 and is preferably provided from an AC adapter (not shown). The VIN signal of FIG. 2 also preferably ranges from 6 to 20 volts. The other side of the choke filter 60 is connected to the drain of an n-channel MOSFET 66, to one side of a capacitor 62 and also to one side of another capacitor 64. The other side of the capacitors 62 and 64 are connected to ground, so that the choke 60 and capacitors 62 and 64 serve to filter the VIN signal. A storage capacitor 112 is also provided between the VIN signal and ground.

The source of the MOSFET 66 is connected to the dotted terminal of a coil 68, which is wound around a core of a transformer T1. Thus the MOSFET 66 provides a current path essentially between the VIN signal and the transformer T1 when activated, which is analogous to the MOSFET Q1 of FIG. 1. The undotted terminal of the coil 68 is connected to a center tap 74, which is connected to one end of another coil 70. The coil 70 is wound around the same core of the transformer T1 as the coil 68. The other side of the coil 70 provides the 5 volt output signal for the converter C2, referred to as the 5 V signal. Three filter capacitors 80, 82 and 84 are coupled in parallel between the 5 V signal and ground. The load of the 5 V signal is not shown for purposes of simplicity. Also, a Zener diode 78 provides overvoltage protection for the 5 V signal, where the anode of the Zener diode 78 is connected to ground and its cathode is connected to the 5 V signal. A synchronous rectifier n-channel MOSFET 90 has its drain connected to the source of the MOSFET 66 and its source connected to ground, otherwise referred to as GND. A resistor 92 and capacitor 94 are coupled in series between the drain and source of the MOSFET 90 and a reverse current protection diode 96 has its anode connected to ground and its cathode connected to the drain of the MOSFET 90. The MOSFET 90 is analogous to the MOSFET Q2 of FIG. 1.

The coils 68 and 70 do not necessarily have the same number of turns so that the center tap 74 is not necessarily at the center. The total inductance of the coils 68 and 70 is chosen to keep the ripple current within tolerable levels with as small an inductance as possible, as described previously for the storage inductor 26. The center tap 74 is connected to the drain of another n-channel MOSFET 76, whose source provides a slave output signal referred to as 3.3 V, which is preferably approximately 3.3 volts. Again, the MOSFET 76 is analogous to the MOSFET Q3 of FIG. 1, and provides a current path between the center tap 74 and the 3.3 V signal when activated. The location of the center tap 74 is chosen to provide the 3.3 V signal, and is not necessarily in the center of the coils 68 and 70. The converter C2 does not provide a separate feedback loop for the 3.3 V signal as did the converter C1 shown in FIG. 1. Thus, the converter C2 is a simplified version so that the center tap 74 is chosen to provide 3.3 volts at the 3.3 V signal and not a greater voltage level, as was done for the converter C1. The 3.3 V signal is filtered by two capacitors 86 and 88 coupled between the 3.3 V signal and ground. The load for the 3.3 V signal is not shown.

A PWM circuit 100 provides the main logic for controlling the MOSFETs 66, 90 and 76. It receives power from a signal VDD which is derived from the VIN signal through a Schottky diode 102, which has its anode connected to the VIN signal and cathode providing the VDD signal. The VDD signal, therefore, essentially follows the voltage level of the VIN signal, although it is preferably kept from falling below nine volts as described below. An oscillator pin of the PWM circuit, referred to as OSC, and also as the OSC signal, is connected to one side of a resistor 104 and to one side of a capacitor 106. The other side of the resistor 104 is connected to the VDD signal and the other side of the capacitor 106 is connected to ground, where the resistor 104 and the capacitor 106 provide frequency adjustment for the PWM circuit 100. Also, one end of a resistor 110 and a capacitor 114 are connected to a PWMTRIG pin of the PWM circuit 100, also referred to as the PWMTRIG signal. The other side of the resistor 110 is connected to the VIN signal and the other side of the capacitor 114 is connected to ground. The PWM circuit 100 is connected to ground through an input referred to as AGND.

An externally provided enable signal, referred to as the OPERATE signal, is connected to the OPERATE input of the PWM circuit 100. A pull up resistor 101 is provided between the OPERATE and VDD signals. During normal operation the OPERATE signal is pulled high. When the OPERATE signal is asserted low, operation of the converter C2 is shut down.

The PWM 100 provides a signal MDRIVE which is coupled to the source of an n-channel field-effect-transistor (FET) 124, where the FET 124 has its gate connected to the VDD signal. The FET 124 remains on during normal operation while the drain of the FET 124 is connected to the base of an NPN bipolar transistor 134 and also to the base of a PNP bipolar transistor 136. The transistors 134 and 136 are connected in a totem pole configuration, where the respective emitters and bases of the transistors 134 and 136 are connected together. The drain of the FET 124 is also connected to one side of a resistor 126, which has its other side connected to the collector of the transistor 134. The VDD signal is coupled to the anodes of two diodes 128 and 130, which have their cathodes connected to one side of a spike limiter resistor 132. The resistor 132 has a small negligible resistance for purposes of the disclosure. The other side of the resistor 132 is connected to the collector of the transistor 134.

The diodes 128 and 130 provide current from the VDD signal to the transistor 134. The collector of the transistor 136 is connected to the anode of a diode 140, which has its cathode connected to the source of the MOSFET 66. A capacitor 142 is connected between the collector of the transistor 134 and the cathode of the diode 140. The diode 140 serves to block current from the transformer T1 from damaging the transistor 136 and the FET 124. The emitters of the transistors 134 and 136 are connected to the gate of the MOSFET 66 and also to the cathode of a diode 144. The anode of the diode 144 is connected to an input of the PWM 100 referred to as MGATE, and also as the MGATE signal. The diode 144 prevents high voltage from appearing to the PWM circuit 100. Thus, the MDRIVE output of the PWM 100 controls the MOSFET 66, where the diode 144 provides a feedback signal called the MGATE input signal to the PWM circuit 100.

The RDRIVE output signal of the PWM circuit 100 is connected to the base of an NPN bipolar transistor 146, which is connected in totem pole configuration with a PNP bipolar transistor 148. Thus, the respective bases and emitters of the transistors 146 and 148 are connected together. The collector of the transistor 146 is connected to the VDD signal and the collector of the transistor 148 is connected to ground. The emitter terminals of the transistors 146 and 148 are connected to the gates of the MOSFETs 76 and 90. A secondary coil 72 of the transformer T1 has its dotted terminal connected to ground and its undotted terminal connected to the anodes of two diodes 152 and 154. The cathodes of the diodes 152 and 154 are connected together and to the VDD signal. The circuit comprising the coil 72 and the diodes 152 and 154 provides a boot-strap circuit to ensure a minimum voltage of the VDD signal, which is preferably approximately 9 volts.

The 5 V signal is connected to one side of a resistor 156 and to one side of a capacitor 160, where the other side of the capacitor 160 is connected to one side of a resistor 158. The other side of the resistors 156 and 158 are connected together and to an ERRNEG input of the PWM circuit 100, also referred to as the ERRNEG signal. As described further below, the ERRNEG signal is connected to the inverting input of an error amplifier 200 (FIG. 3) used to sense the 5 V signal. The ERRNEG signal is also connected to one side of a capacitor 162, which has its other side connected to one side of a resistor 164. The other side of the resistor 164 is connected to one side of a capacitor 166 and to an output signal of the PWM circuit 100, referred to as ERROUT. The other side of the capacitor 166 is connected to the ERRNEG signal. The ERROUT signal is the output of the error amplifier 200 and is provided for external compensation, which is the function of the resistor 164 and the capacitors 162 and 166.

The PWM circuit 100 provides a voltage reference signal referred to as VREF, which is preferably approximately 5 volts. The VREF signal is connected to one side of a capacitor 116, and the other side of the capacitor 116 is connected to ground. The VREF signal is also connected to one side of a resistor 118 and to one side of a capacitor 120, where the other sides of the resistor 118 and the capacitor 120 are connected together and to an adjustment input of the PWM circuit 100, referred to as the REFADJ signal, which provides adjustment for the VREF signal. The REFADJ signal is also connected to one side of a resistor 122, which has its other side connected to ground. The VREF signal is also connected to one side of a resistor 168, which has its other side connected to an ERRPOS input of the PWM circuit 100, also referred to as the ERRPOS signal. A filter capacitor 170 is connected between the ERRPOS signal and ground. The operation of the converter C2 will be described below, but first the PWM circuit 100 will be described.

Figure 3:
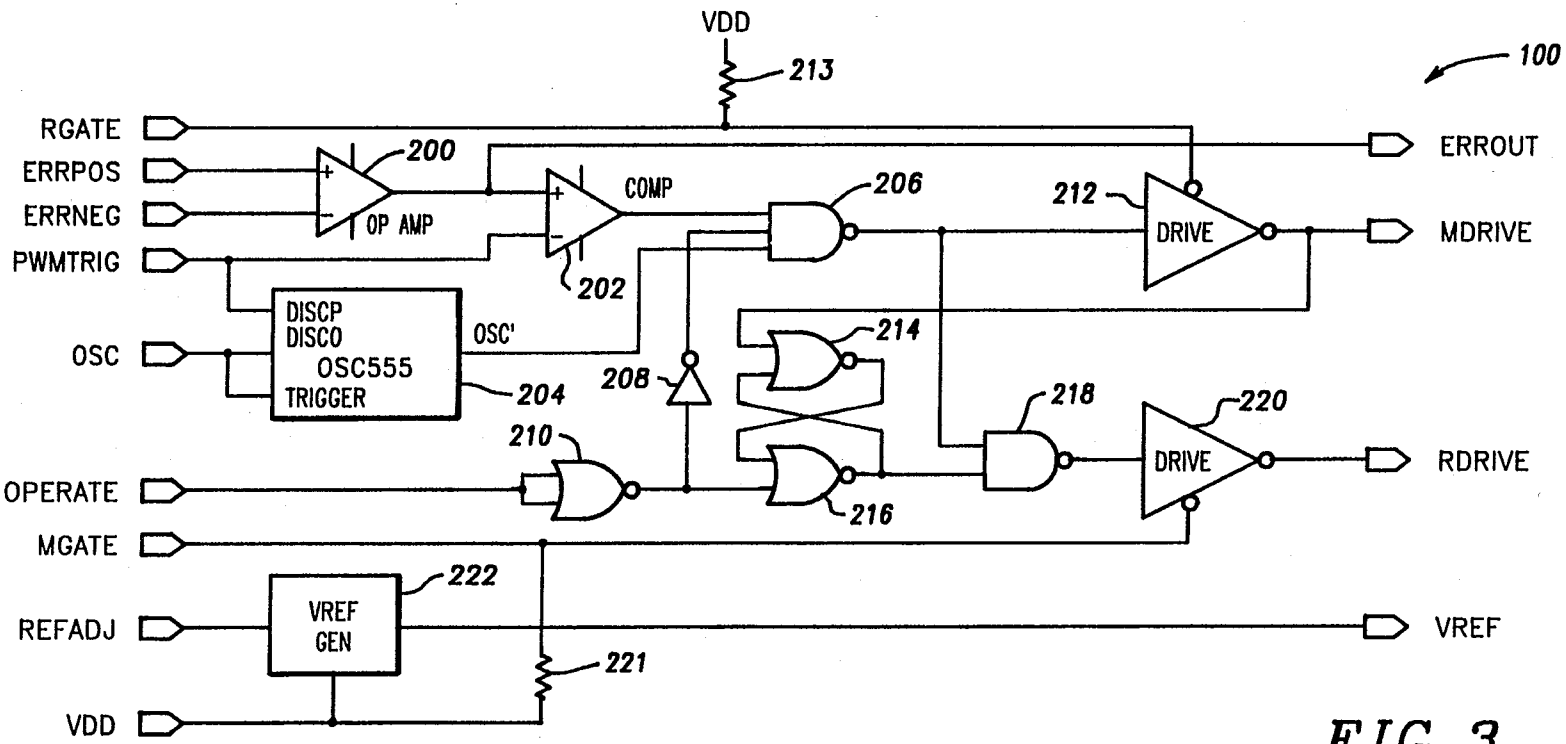
FIG. 3 is a simplified schematic diagram of the pulse width modulation circuit of FIG. 2.

Referring now to FIG. 3, a simplified block diagram of the PWM circuit 100 of FIG. 2 is shown. The ERRPOS signal is provided to the non-inverting input of the error amplifier 200, which also receives the ERRNEG signal at its inverting input. Since the ERRPOS signal is derived from the VREF signal and the ERRNEG signal is a proportional voltage signal received from the 5 V signal, the output of the error amplifier 200 provides the ERROUT signal, which has a voltage level proportional to the difference between the VREF and 5 V signals. As described previously, the ERROUT signal is provided externally to the PWM circuit 100 for external compensation purposes, which is provided by the resistor 164 and the capacitors 162 and 166, which are coupled between the ERROUT signal and the ERRNEG signal. The ERROUT signal is asserted low when the value of the ERRNEG signal exceeds the level of the ERRPOS signal. The ERROUT signal is provided to the non-inverting input of a comparator 202, which receives the PWMTRIG signal at its inverting input. As will be described more fully below, the PWMTRIG signal is in the form of a sawtooth signal so that the output of the comparator 202 is high while the ERROUT signal is greater then the PWMTRIG signal. The PWMTRIG and OSC signals are also provided to a timer 204 which is preferably a 555 timer. The PWMTRIG signal is connected to one of two identical discharge transistor outputs in the timer 204, with the OSC signal connected to the other discharge output. The OSC signal is also connected to the trigger input of the timer 204 so that it operates in a stable mode with a frequency based on the resistor 104 and the capacitor 106.

Figure 4:
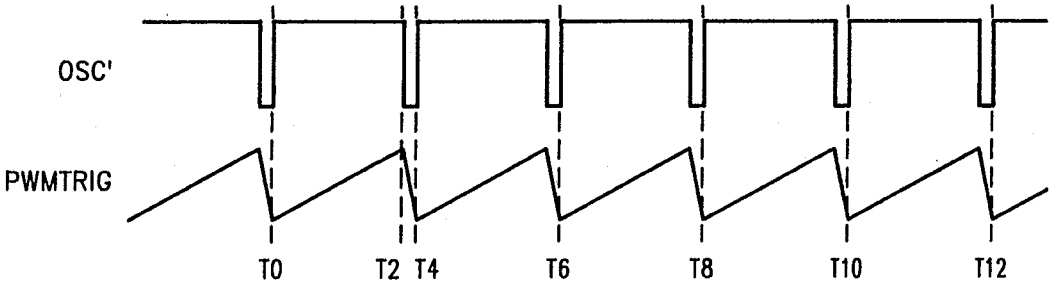
FIG. 4 is a timing diagram illustrating the operation of the timer of the PWM circuit of FIG. 3.

The relationship between the PWMTRIG and the OSC signals as determined by the timer 204 is shown more clearly in FIG. 4, where the OSC′ signal is generally a square wave having a relatively high duty cycle. The PWMTRIG signal is low but begins ramping up at a rate based on the VIN signal at a time TO at the same time the OSC′ signal is asserted high as the discharge transistors have turned off. The OSC′ signal remains high while the PWMTRIG signal is ramping up until a time T2, at which time the PWMTRIG signal ramps negatively and the OSC′ signal is asserted low. The PWMTRIG signal ramps negatively and the OSC′ signal remains low until a time T4, when the cycle is started again. The cycles repeat beginning at times T6, T8, T10 and T12 as shown, so that the OSC′ and PWMTRIG signals remain synchronized.

Referring back to FIG. 3, the output of the comparator 202 is provided to one input of a three-input NAND gate 206, which also receives the OSC′ signal from the timer 204 at a second input. The third input of the NAND gate 206 is connected to the output of an inverter 208, which receives at its input the output of a two-input NOR gate 210. Both inputs of the NOR gate 210 are connected to the OPERATE signal, so that during normal operation, the OPERATE signal is high and the output of the inverter 208 remains high. The output of the NAND gate 206 is provided to the input of a inverter driver 212, which provides the MDRIVE signal at its output. The RGATE signal is provided to an inverted enable input of the inverter driver 212 and also to one side of a pullup resistor 213. The other side of the resistor 213 is connected to the VDD signal. In this manner, the RGATE signal effectively disables the MDRIVE signal when the RGATE signal is pulled high, which occurs when the RDRIVE signal is asserted. Thus, the RGATE signal prevents the MDRIVE signal from being asserted while the RDRIVE signal is asserted.

The MDRIVE signal is provided to one input of a two-input NOR gate 214, which has its output connected to one input of another two-input NOR gate 216. The output of the NOR gate 216 is provided to the other input of the NOR gate 214, and the output of the NOR gate 210 is provided to the other input of the NOR gate 216. The output of the NOR gate 216 is provided to one input of a two-input NAND gate 218, which receives the output of the NAND gate 206 at its other input. The output of the NAND gate 218 is provided to an inverter driver 220, which provides the RDRIVE signal at its output. The MGATE signal is provided to the inverter enable input of the inverter driver 220 and to one side of a pullup resistor 221. The other side of the pullup resistor 221 is connected to the VDD signal. The MGATE signal effectively prevents the RDRIVE signal from being asserted while the MDRIVE signal is asserted. The NOR gates 214 and 216 function as a startup lockout latch which is set by the MDRIVE signal and reset by the OPERATE signal. This latch ensures that the MDRIVE signal is asserted at least once before the RDRIVE signal is asserted to allow a shorter startup time for the PWM circuit 100.

The NAND gate 206 is used in conjunction with the OSC' signal to gate the output of the comparator 202 to the inverter drivers 212 and 220. Under normal conditions when the output of the OSC' signal is low, the MDRIVE signal is driven low and the RDRIVE signal is asserted high. While the OSC' and OPERATE signals are high, the output of the comparator 202 is provided to the NAND gate 218 and to the driver 212. If the output of the comparator 202 is asserted high, the MDRIVE signal is asserted high and the RDRIVE signal is asserted low. Otherwise, if the output of the comparator 202 is low, the MDRIVE signal is driven low and the RDRIVE signal is asserted high. The VDD and REFADJ signals are provided to a VREF generator 222, which provides the VREF signal at its output.

The operation of the converter C2 of FIG. 2 can now be described. The 5 V signal is compared with the VREF signal through the error amplifier 200, which is compared through the comparator 202 with the sawtooth wave-form PWMTRIG. For each cycle of the PWM circuit 100, if the 5 V signal is above the VREF signal, the MDRIVE signal remains asserted low until the 5 V signal drops below the VREF signal. When this occurs, the MDRIVE signal is asserted high at the beginning of each cycle and remains asserted until the PWMTRIG signal becomes greater than the ERROUT signal. When the MDRIVE signal is asserted, the transistor 134 is turned on, which activates the MOSFET 66 allowing current to flow from the VIN signal through the current path of the MOSFET 66 into the coils 68 and 70 of the transformer T1 to develop the 5 V signal. During this time, the RDRIVE signal remains low turning on the transistor 148 to keep the MOSFET 90 and the MOSFET 76 turned off. When the PWMTRIG signal becomes greater then the ERROUT signal, the output of the comparator 202 goes low, which causes the MDRIVE signal to be asserted low, thus turning off the transistor 134 and activating the transistor 136. This turns off the MOSFET 66 where its gate capacitance is drained through the transistor 136. The RDRIVE signal is asserted when the MDRIVE signal is negated, which activates the transistor 146, which turns on the MOSFETs 90 and 76. The MOSFET 90 provides a freewheel current path through the coils 68 and 70 to the 5 V signal and through the load provided to the 5 V signal. The MOSFET 76 is turned on during the freewheel portion of each cycle, which provides a current path between the center tap 74 and the 3.3 V signal to develop the voltage of the 3.3 V signal. The RDRIVE signal remains asserted during normal operation until the MDRIVE signal is once again asserted.

It was previously noted that there is no separate feedback loop provided for the 3.3 V signal as was provided for the VO2 signal of FIG. 1. Thus, the 3.3 V signal is essentially a slave output voltage of the 5 V signal for the converter C2 of FIG. 2 and is controlled by the feedback circuit of the 5 V signal. When the RDRIVE signal is asserted low, the transistor 146 is turned and the transistor 148 is turned on thereby turning off the MOSFETs 90 and 76. The feedback loop of converter C1 for the 3.3 V signal provides an advantage of tighter output regulation which is used to provide higher output currents to circuits requiring higher power. The converter C2 is sufficient for lower current purposes and allows a simpler design. In some cases the simpler slave circuit of converter C2 will provide an acceptable 3.3 V signal over the expected current ranges, but in other cases tighter control may be necessary, so the separate 3.3 V feedback loop would be used.

It can now be appreciated that due to the operation of the tapped inductor slave regulating circuit according to the present invention, a second slave voltage can be derived from a first output voltage without the size and cost of additional magnetic components or the losses associated linear pass elements.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. A switching converter for providing a first output to a first load and a second output to a second load, comprising:

means for providing an unregulated DC voltage;

a storage inductor having a first end, a second end for coupling to the first load and for providing the first output, and a center tap;

a pulse width modulating means receiving a feedback signal for providing a square wave with variable duty cycle, wherein said duty cycle is determined by said feedback signal and wherein each cycle comprises a power phase followed by a freewheel phase;

a first switching means coupled to said unregulated DC voltage and said first end of said storage inductor and receiving said square wave from said pulse width modulating means, for coupling said unregulated DC voltage to said storage inductor during said power phase of each cycle, and for essentially isolating said storage inductor from said unregulated DC voltage and coupling said storage inductor first end to ground during said freewheel phase of each cycle;

a feedback circuit for coupling to the first output and providing said feedback signal indicative of the level of the first output; and a second switching means having a control terminal receiving said square wave and a current path coupled between said center tap and the second output for providing the second output, wherein said second switching means current path is enabled during said freewheel phase and disabled during the power phase of each cycle.

2. The switching converter of claim 1, wherein said pulse width modulating means comprises:

means for generating a reference voltage;

an error amplifier connected to said feedback circuit and said reference voltage generating means for comparing said feedback signal with said reference voltage and for providing a proportional error signal;

timing means for generating an oscillating clock signal having high and low portions;

means connected to said timing means and said unregulated DC voltage for providing a sawtooth signal synchronous with said oscillating clock signal, wherein said sawtooth signal ramps up based on the unregulated DC voltage and ramps down during low portions of said oscillating clock signal;

a comparator receiving said error signal and said sawtooth signal for providing an output signal indicative of the relationship of said sawtooth signal and said error signal; and means receiving said comparator output signal, said error signal and said oscillating clock signal for providing said square wave with a power phase developed when said sawtooth signal is less than said error signal and a freewheel phase when said sawtooth signal is greater than said error signal or said oscillating clock signal is low.

3. The switching converter of claim 1, wherein said pulse width modulating means further comprises:

a first driver means receiving said square wave for providing a buffered version of said square wave; and a second driver means receiving said square wave for providing an inverted and buffered version of said square wave.

4. The switching converter of claim 3, wherein said first switching means comprises:

a first switch having a current path coupled between said unregulated DC voltage and said storage inductor first end and a control terminal receiving said buffered version of said square wave, wherein said first switch is turned on during said power phase and turned off during said freewheel phase of each cycle; and a second switch having a current path coupled between ground and said storage inductor first end and a control terminal receiving said inverted and buffered version of said square wave, wherein said second switch is turned off during said power phase and turned on during said freewheel phase of each cycle.

5. The switching converter of claim 4, wherein said first switch and said second switch each include:

an NPN bipolar transistor and a PNP bipolar transistor coupled in a totem pole configuration wherein the bases of said NPN and PNP transistors are coupled together and form said control terminal; and a metal oxide semiconductor field effect transistor having its gate coupled to the emitters of said NPN and PNP transistors, and wherein its drain and source provide said current path.

6. A switching converter for providing a first output to a first load and a second output to a second load, comprising:

means for providing an unregulated DC voltage;

a storage inductor having a first end, a second end for coupling to the first load and for providing the first output, and a center tap;

a pulse width modulating means receiving a first feedback signal for providing a square wave with variable duty cycle, wherein said duty cycle is determined by said first feedback signal and wherein each cycle comprises a power phase followed by a freewheel phase;

an inverter receiving said square wave and providing an inverted version of said square wave;

a first switch having a current path coupled between said unregulated DC voltage and said first end of said storage inductor and having a control terminal receiving said square wave, for coupling said unregulated DC voltage to said storage inductor first end during said power phase and for essentially isolating said storage inductor first end from said unregulated DC voltage during said freewheel phase of each cycle;

a second switch having a current path coupled between said storage inductor first end and ground and having a control terminal receiving said inverted version of said square wave, for coupling said storage inductor first end to ground during said freewheel phase of each cycle;

a feedback circuit for coupling to the first output and providing said first feedback signal indicative of the level of the first output;

a third switch having a control terminal and a current path coupled between said center tap and the second output for providing the second output;

means for generating a reference voltage;

a comparator having one input coupled to the second output and another input receiving said reference voltage, for providing a second feedback signal indicative of the second output having a voltage level lower than said reference voltage; and a gate receiving said second feedback signal and said inverted version of said square wave and having an output coupled to said third switch control input, for turning on said third switch during said freewheel phase when the second output has a voltage level lower than said reference voltage.

7. The switching converter of claim 6, wherein said first, second and third switches comprise metal oxide semiconductor field effect transistors.

8. The switching converter of claim 6, wherein said pulse width modulating means comprises:

means for generating a reference voltage;

an error amplifier connected to said feedback circuit and said reference voltage generating means for comparing said feedback signal with said reference voltage and for providing a proportional error signal;

timing means for generating an oscillating clock signal having high and low portions;

means connected to said timing means and said unregulated DC voltage for providing a sawtooth signal synchronous with said oscillating clock signal, wherein said sawtooth signal ramps up based on the unregulated DC voltage and ramps down during low portions of said oscillating clock signal;

a comparator receiving said error signal and said sawtooth signal for providing an output signal indicative of the relationship of said sawtooth signal and said error signal; and means receiving said comparator output signal, said error signal and said oscillating clock signal for providing said square wave with a power phase developed when said sawtooth signal is less than said error signal and a freewheel phase when said sawtooth signal is greater than said error signal is greater than said error signal or said oscillating clock signal is low.

* * * * *